United States Patent [19]

Coetzer et al.

[11] Patent Number: 4,846,943

[45] Date of Patent: Jul. 11, 1989

[54] MANUFACTURE OF AN ALKALI METAL ALUMINUM HALIDE COMPOUND AND ALKALI METAL

[75] Inventors: Johan Coetzer, Pretoria; Roger J. Wedlake, Johannesburg, both of South Africa

[73] Assignee: Lilliwyte Societe Anonyme, Luxembourg

[21] Appl. No.: 58,920

[22] Filed: Jun. 5, 1987

[30] Foreign Application Priority Data

Jun. 6, 1986 [GB] United Kingdom ..... 8613798

[51] Int. Cl.[4] ..... C25B 1/00

[52] U.S. Cl. ..... 204/61; 204/68

[58] Field of Search ..... 204/61, 68

[56] References Cited

U.S. PATENT DOCUMENTS

| | | | |
|---|---|---|---|
| 3,404,036 | 10/1968 | Kummer et al. | 136/2 |
| 3,488,271 | 1/1970 | Kummer et al. | 204/180 |
| 3,607,684 | 9/1971 | Kuhn | 204/68 |
| 4,108,743 | 8/1978 | Minck | 204/64 R |
| 4,203,819 | 5/1980 | Cope | 204/247 |

FOREIGN PATENT DOCUMENTS

| | | | |
|---|---|---|---|
| 1200103 | 7/1970 | United Kingdom | 204/68 |

OTHER PUBLICATIONS

Kamaludeen et al., "Sodium Hydroxide by Fused Salt Electrolysis with Beta Alumina Diaphragm", 21 Transactions of the SAEST, No. 1 (1986), at 53–56.

Ito, "A New Method for the Electrolysis of Sodium Chloride Using a Beta-Alumina-Molten Salt System", 6 Journal of applied Electrochemistry, 361–364 (1976).

Cherng et al., "A Na/Beta-Alumina/$NaAlCl_4$, $Cl_2$/C Circulating Cell", 8 Proc Electrochem Soc (Pesod), No. 12 at 243–257.

Marassi et al., "Electrochemistry of Iodine and Iodine in Chloroaluminate Melts", 69 J. Electroanal. Chem. at 345–349 (1976).

Munday et al., "An electromotive Force Study of Lower Oxidation States of Lead, Cadmium, and Tin in Molten $NaAlCl_4$", 5 Inorganic Chemistry, No. 7 at pp. 1263–1264 (1966).

*Primary Examiner*—John F. Niebling
*Assistant Examiner*—Kathryn Gorges
*Attorney, Agent, or Firm*—Arnold, White & Durkee

[57] ABSTRACT

A method of making an (alkali metal) (metal) halide compound and an alkali metal, the compound having the formula $MDHal_{x+1}$ in which D is a metal; M is an alkali metal; Hal is a halide; and x is the valency of the metal D. The compound is made by exposing to one another a molten $MDHal_{x+1}$ compound, a metal D and an alkali metal halide having the formula MHal. The $MDHal_{x+1}$ compound is separated from a molten alkali metal M by means of a separator which is in contact with both the molten $MAlHal_4$ and molten alkali metal. The separator can include a solid conductor of ions of the alkali metal or a micromolecular sieve having the alkali metal absorbed therein. A sufficient electrical potential is applied across the electrolytic cell D/MHal/$MDHal_{x+1}$ || separator || alkali metal to cause the following reactions to take place: $xMHal+D \rightarrow XM+DHal_x$ and $MHal+DHal_x \rightarrow MDHal_{x+1}$. The alkali metal formed in the first reaction passes through the separator and into the molten alkali metal. The electrical potential is a direct current potential arranged so that electrons are fed via an external circuit into the molten alkali metal.

8 Claims, 4 Drawing Sheets

MANUFACTURE OF AN ALKALI METAL ALUMINUM HALIDE COMPOUND AND ALKALI METAL

This invention relates to the manufacture of an (alkali metal) (metal) halide compound and alkali metal.

In accordance with the invention, a method of making an (alkali metal) (metal) halide compound and alkali metal, which compound has the formula M D $Hal_{x+1}$ in which D is a metal;

M is an alkali metal;

Hal is a halide; and x is the valency of the metal D, comprises exposing to one another a molten $MDHal_{x+1}$ compound as defined above, a metal D and an alkali metal halide according to the formula MHal where the M and Hal in the MHal are as defined above and are the same alkali metal and halide respectively as in the M D $Hal_{X+1}$, separating the $MDHal_{x+1}$ compound from a molten alkali metal which is the same as the alkali metal in the $MDHal_{x+1}$ and the MHal, by means of a separator which is in contact with both said molten $MDHal_{x+1}$ and molten alkali metal and comprises a solid conductor of ions of said alkali metal or comprises a micromolecular sieve having said alkali metal absorbed therein, and applying a sufficient electrical potential across the electrolytic cell D/MHal/$MDHal_{x+1}$ || separator || alkali to cause the following reactions to take place:

$$xMHal + D \rightarrow xM + DHal_x \quad (1);$$

and $$MHal + D\ Hal_x \rightarrow MDHal_{x+1} \quad (2),$$

the alkali metal formed in reaction (1) passing through the separator and into the molten alkali metal, and the electrical potential being a direct current potential arranged so that electrons are fed via an external circuit into the molten alkali metal.

In this regard it should be noted that the electrical potential in fact causes electrochemical reaction (1) to take place, chemical reaction (2) following automatically as the $DHal_x$ is produced by reaction (1).

The $MDHal_{x+1}$ compound thus formed can typically be used as an electrolyte in an electrochemical cell.

The metal D may be a member of the group comprising aluminum, (in which case x is 3), and zinc (in which case x is 2) the separator being a solid conductor of alkali metal ions, eg a solid conductor of sodium ions such as beta-alumina or nasicon, so that the alkali metal formed in reaction (1) passes through the separator in ionic form and is discharged to the metallic form when it is released from the separator to the molten alkali metal.

In another embodiment of the ivention, the separator may be a micromolecular sieve such as tectosilicate, eg a felspar, felspathoid, or zeolite. In this case the alkali metal formed in reaction (1) may pass through the separator in ionic form or metallic form to be released in metallic form from the separator into the molten alkali metal.

The metal may in particular be aluminum, the method accordingly involving the consumption of the aluminum and alkali metal halide starting materials and the formation of additional $MAlHal_4$ on the one side of the separator, and the formation of additional alkali metal on the other side of the separator. In accordance with the reaction scheme represented by reactions (1) and (2) above, for every mole of aluminum which is consumed, 4 moles of M Hal are consumed, with the formation of one mole of M Al $Hal_4$ and three moles of alkali metal, according to the overall reaction $$4MHal + Al \rightarrow MAlHal_4 + 3M \quad (3).$$

The method of the invention may be carried out batchwise or preferably continuously or at least semi-continuously, with aluminum and MHal being added continuously or intermittently in stoichiometric proportions to the $MAlHal_4$ on one side of the separator, $MAlHal_4$ being continuously or intermittently withdrawn, as it is produced, from that side of the separator, and alkali metal continuously or intermittently being withdrawn, as it is produced, from the other side of the separator.

While it is possible in theory to start the reactions with no molten alkali metal on the opposite side of the separator from the $MAlHal_4$, problems can be encountered in causing electrons to enter that side of the separator. It is accordingly convenient to start the reactions with a starting amount of molten alkali metal on that side of the separator, to wet the separator, and to ensure as far as possible an even current density through the separator. On the other hand, a quantity of molten $MAlHal_4$ will always be required, to wet the separator and the aluminum and alkali metal halide starting materials, which are preferably present in stoichiometric proportions at the start of the reactions.

The reactions will be carried out at a temperature at which both the $MAlHal_4$ and alkali metal are molten, the temperature preferably being adequately but not excessively above their melting points, the alkali metal halide and aluminum typically being present in solid form. The alkali metal halide may be in more or less finely divided particulate form but the aluminum is conveniently present as a unitary mass, so that it may act as a terminal for the external circuit. For the other end of the external circuit a stainless steel or aluminum terminal may be provided, extending into the molten alkali metal.

Put into other words, in accordance with the invention there is provided a method of making an alkali metal aluminum halide compound of the formula $MAlHal_4$ as defined above, and alkali metal, which includes operating an electrolytic cell which comprises said $MAlHal_4$ in molten form separated from a molten alkali metal which is the same as the alkali metal in the $MAlHal_4$, by a separator which is in contact with both said molten $MAlHal_4$ and molten alkali metal and comprises a solid conductor of ions of said alkali metal or comprises a micromolecular sieve having said alkali metal sorbed therein, electrons from the external circuit of the electrolytic cell being fed into the molten alkali metal to give rise to reactions (1) and (2) as set out above.

In particular embodiment of the invention the compound is sodium aluminium chloride according to the formula $NaAlCl_4$, the alkali metal halide being sodium chloride, the molten alkali metal being sodium, and the separator being beta-alumina, with the cell operating at a temperature sufficient to melt the $NaAlCl_4$, eg at least 165° C., and the electrical potential applied by the external circuit being above the formation potential of $AlCl_3$ according to reaction (1) above, ie at least 1.8 volts. In this embodiment, the terminal of the external circuit in contact with the $NaAlCl_4$ may be a consumable aluminum bar or rod, the other terminal may be a stainless steel or aluminum rod and sodium chloride in particulate form may be added to the $NaAlCl_4$ at the average rate at which it is consumed, the aluminum bar being replaced when necessary. The molten sodium will be tapped off as it is produced and so will the $NaAlCl_4$ produced, conveniently through a porous filter, the filter and the size of the NaCl particles employed being selected such that the particles or at least undesirably large particles do not pass the filter.

The $NaAlCl_4$ initially present at the start of the reaction may conform substantially with the stoichiometric formula, ie it comprises an equimolar mix of NaCl and $AlCl_3$, thereby ensuring that the Na Cl employed is substantially insoluble therein. However, even if the starting $NaAlCl_4$ is $AlCl_3$-rich, some of the Na Cl starting material will merely be taken up therein until stoichiometric proportions are reached. Thereafter, reactions (1) and (2) will ensure that these stoichiometric proportions are maintained.

While reactions (1) and (2) may take place in a single zone or compartment, they may be physically separated to take place in separate zones or compartments. Thus the invention may include the steps of circulating, as a solution in $MAlHal_4$, the $AlHal_3$ from a first zone where it is produced according to reaction (1), to a second zone containing the M Hal where it reacts with the MHal according to reaction (2) to produce the $MAlHal_4$, and recirculating the $MAlHal_4$ back to the first zone. This procedure can have the advantage that the flowing $MAlHal_4$ can sweep the Al and separator surfaces in said first zone, to prevent a build-up of $AlHal_3$ there, which build-up can possibly cause an undesirable concentration gradient which can affect the internal resistance of the electrolytic cell, and in particular it has the advantage of avoiding or reducing possible poisoning of the separator by and $AlHal_3$ produced.

The invention will now be described, by way of example, with reference to the accompanying diagrammatic drawings, in which.

Figure 1:
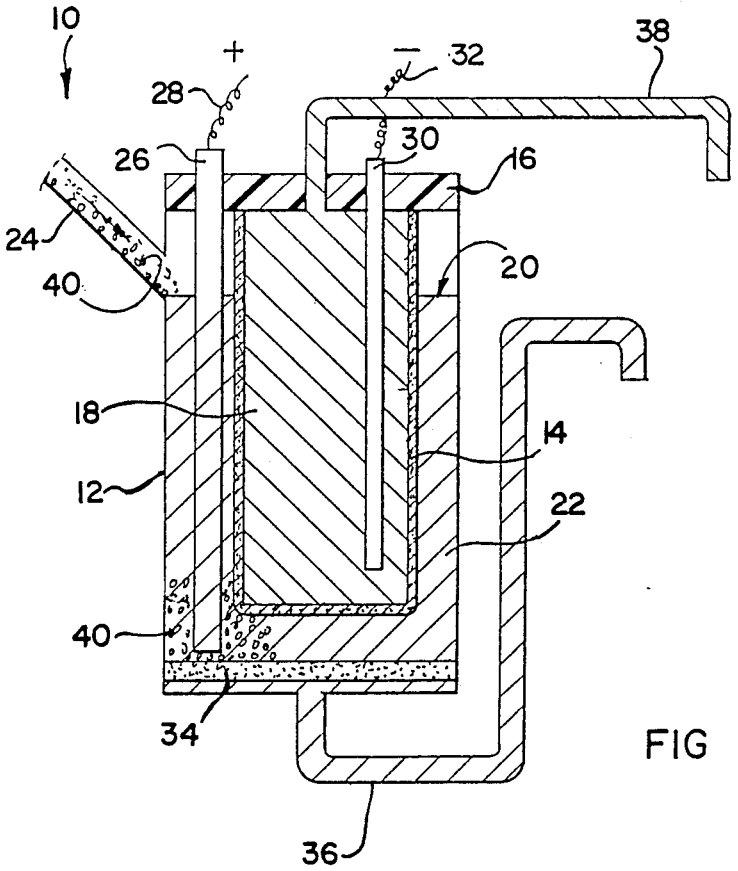
FIG. 1 shows a schematic sectional side elevation of an electrolytic test cell operable in accordance with the present invention.

In FIG. 1 of the drawings, reference numeral 10 generally designates an electrolytic cell comprising a cylindrical steel housing 12, concentrically within which is located a beta-alumina tube 14, the upper ends of which housing and tube are sealed off by an electrically insulating seal 16.

The interior of the tube 14 is shown filled with molten sodium 18. The housing 12, outside the tube 14, is shown partially filled to level 20 with molten $NaAlCl_4$, designated 22, and is shown provided with a sodium chloride inlet 24.

A consumable aluminum bar 26 is shown extending downwardly through the seal 16 into the $NaAlCl_4$ 22, being connected to the positive end 28 of an external electrical circuit. A stainless steel bar 30 is shown in turn extending downwardly through the seal 16 into the molten sodium 18, being connected to the negative end 32 of the external circuit.

A porous filter 34 is shown extending across the housing 12, spaced below the tube 14 and bar 26. Below the filter 34 the housing has an outlet conduit 36, arranged to provide for overflow of $NaAlCl_4$ from the housing through the filter 34, while maintaining the level 20 of the moltern $NaAlCl_4$ 22 in the housing at the height where the inlet 24 enters said housing 12. The interior of the tube 14 in turn is provided with a sodium outlet conduit 38, passing up through the seal 16 and arranged to permit overflow of molten sodium 18 from the tube 14, while keeping the tube full of sodium.

Particulate sodium chloride, the minimum particle size of which is chosen to be easily stopped from passing through the filter 34, is fed into the $NaAlCl_4$ via the inlet 24. An electrical potential of about 1.8 volts is then applied to the bar 26 and rod 30 from the external electrical circuit, so that the bar 26 and rod 30 act respectively as the positive and negative terminals of the circuit and cell 10.

In the cell, the electrical potential causes the following reactions (in accordance with general reactions (1), (2) and (3) to take place, namely:

$$3NaCl + Al \rightarrow 3Na + AlCl_3 \quad (4);$$

and $$NaCl + AlCl_3 \rightarrow NaAlCl_4 \quad (5),$$

ie the overall reactions:

$$4NaCl + Al \rightarrow NaAlCl_4 + 3Na \quad (6),$$

the $NaAlCl_4$ being produced in the housing 12 outside the tube 14 and the Na passing through the tube 14 in ionic form to be discharged into the interior of the tube 14 as sodium metal. For every mole of Al consumed, a mole of $NaAlCl_4$ is produced, together with 3 moles of Na, while 4 moles of NaCl are simultaneously consumed.

The rate of $NaAlCl_4$ production will depend essentially on the internal resistance of the cell, assuming an unrestricted current supply and an unrestricted supply of NaCl, NaCl being added as required, as shown at 40, via the inlet 24, and the bar 26 being consumed. Usually, the internal resistance of the cell will be controlled by the temperature of operation, size (area) of the tube 14 and its thickness, the larger the tube the lower the internal resistance, and the thinner the tube the lower the internal resistance.

$NaAlCl_4$ produced will overflow more or less continuously from the housing 12 outside the tube 14 and via the conduit 36, and Na produced will overflow more or less continuously from the tube 14 via the conduit 38, NaCl 40 being added via the inlet 24 continuously or intermittently as required, and the bar 26 being replaced when required. The $NaAlCl_4$ produced is filtered to be essentially free of NaCl by the filter 34, which is a microporous filter.

Figure 2:
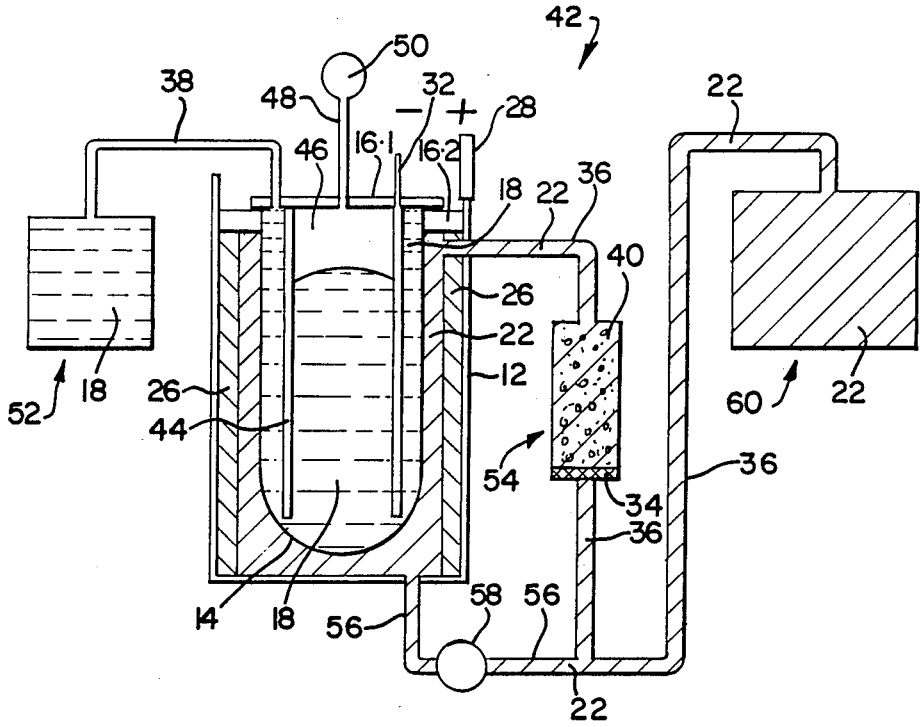
FIG. 2 shows a similar view of a somewhat more complex cell operable in accordance with the invention.

In FIG. 2, the same reference numerals are used for the same parts as in FIG. 1, unless otherwise specified. In FIG. 2, reference numeral 42 generally designates an electrolytic cell for the present invention, which is somewhat different in certain respects from the cell 10 of FIG. 1.

In particular, whereas in FIG. 1 the sodium chloride 40 and aluminum 26 are in a common compartment wherein both reactions (4) and (5) take place, in FIG. 2 an arrangement is shown where reactions (4) and (5) above take place in separate compartments.

In FIG. 2 the housing 12 is shown made of mild steel as is the current collector for the sodium anode material (not shown but equivalent to the current collector 30 of FIG. 1) to which the terminal 32 is connected. The beta-alumina tube 14 is shown having a mild steel inner tube 44 concentrically located therein, at the top of which is a gas space 46 containing an inert gas such as nitrogen, connected by a tube 48 to a pressure gauge 50. The gas space 46 and pressure gauge 50 are provided to permit the monitoring of undesired pressure build-ups in the beta-alumina tube 14. The conduit 38 is shown leading to a sodium store or reservoir 52 for sodium produced by the present invention.

Other changes in detail compared with FIG. 1 include the provision of the aluminum 26 in the form of a concentric cylindrical liner for the housing 12, which is also cylindrical, and separate electrically insulating seals 16.1 and 16.2 for the beta-alumina tube 14 and housing 12 respectively.

The main difference however in FIG. 2 when compared with FIG. 1 is that the sodium chloride 40 is provided in a separate compartment defined by a housing 54 to which the $NaAlCl_4$ product conduit 36 leads, the filter 34, if provided, being located at the outlet of this housing 54. The conduit 36 includes, downstream of the housing 54, a branch pipe 56 which returns via a suitable pump 58 to the interior of the housing 12, the conduit 36 leading eventually to a $NaAlCl_4$ product reservoir 60.

In use, reaction (4) takes place in the housing (12), with $AlCl_3$ being produced adjacent the aluminum 26. Recirculated $NaAlCl_4$ fed into the bottom of the housing 12, circulates through the housing 12, sweeping the surfaces of the beta-alumina tube 14 and aluminum 26, to exit from the housing 12 via conduit 36 leading to the housing 54. The $NaAlCl_4$ leaving the housing 12 via the conduit 36 contains $AlCl_3$ which has formed adjacent the surface of the aluminum 26 and has dissolved readily in the $NaAlCl_4$ in the housing 12, which $NaAlCl_4$ in consequence becomes acid rich in a Lewis acid sence. This $AlCl_3$-acid rich $NaAlCl_4$ enters the housing 54, where reaction (5) above takes place. The NaCl in the housing 54 exists as a fixed bed of NaCl particles, and its size, together with the particle size of the NaCl, the flow rate of $NaAlCl_4$ though the housing 54 and the temperature of the $NaAlCl_4$ in the housing 54 are selected in combination such that the liquid emerging from the bottom of the housing 54 is substantially pure $NaAlCl_4$, saturated with regard to NaCl and filtered by the filter 34, if desired. Substantially pure $NaAlCl_4$, comprising an equimolar mix of NaCl and $AlCl_3$ is thus recirculated via the conduit 56 and pump 58, excess or product $NaAlCl_4$ passing along the conduit 36 to the $NaAlCl_4$ reservoir 60.

A feature of the arrangement in FIG. 2 is that recirculated $NaAlCl_4$ is caused to flow through the housing 12 to sweep away the $AlCl_3$ as it is produced from the surface of the aluminium 26, thereby preventing build-up of $AlCl_3$ between said aluminum 26 and the beta-alumina 14, which build-up can possibly cause an undesirable concentration gradient which can affect the internal resistance of the cell, and in particular the surface of the beta-alumina tube 14 is swept, thereby to reduce or avoid possible poisoning of the beta-alumina by any $AlCl_3$ produced.

The mild steel tube 44 in the beta-alumina tube 14 has its upper end sealed to the seal 16.1, and functions merely to provide the gas space 46, leading through the tube 48 to the pressure gauge 50. Monitoring of the pressure gauge can indicate if and when an undesirably high pressure has built-up in the interior of the beta-alumina tube 14, so that steps can be taken to avoid breakage of said beta-alumina tube 14 by this pressure.

Figure 4:
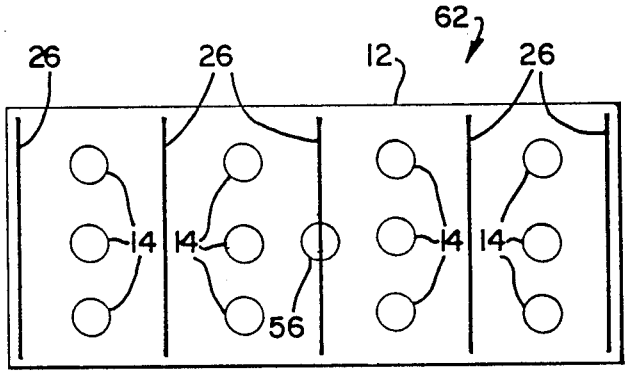
FIG. 4 shows a sectional plan view in the direction of line IV—IV in FIG. 3.
Figure 3:
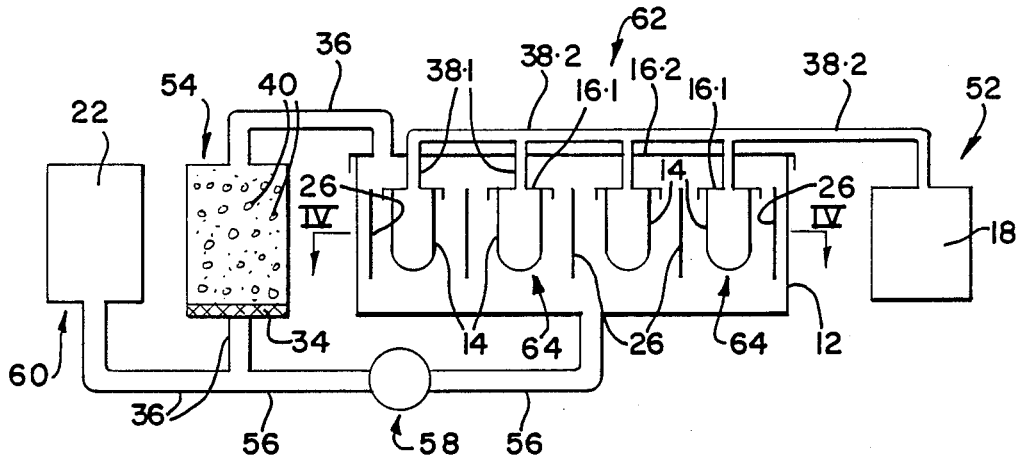
FIG. 3 shows a similar view of a battery of cells operable in accordance with the present invention.

Turning now to FIG. 3 and FIG. 4, once again, the same reference numerals are used for the same parts as in FIGS. 1 and 2, unless otherwise specified. In FIGS. 3 and 4 a "battery" of electrolytic cells of the type embodied by FIGS. 1 and 2 is shown, generally designated 62. In this battery, a plurality of beta-alumina tubes 14, arranged in a rectangular pattern of four rows of three tubes each, is shown located in common housing 12, each tube 14 having its own seal 16.1 and the housing 12 having a single seal 16.2. Each of the tubes 14 has an outlet conduit 38.1 for sodium through its seal 16.1, the tubes 38.1 leading in the fashion of a manifold into a common outlet tube 38.2 which leads to the sodium reservoir 52.

In the housing 12, the aluminum 26 is provided in the form of aluminum sheets or plates which separate the tubes 14 in groups of three from one another, as shown in FIG. 4, there being vertical plates 26 on opposite sides of each of the tubes 14. The plates 26 are parallel to the end walls of the housing 12, having upper and lower edges which are spaced from the top and bottom of the housing. The plates 26 are spaced in series from one another along the length of the housing 12 and there are plates 26 respectively between the end walls of the housing 12, and the adjacent groups of tubes 14.

The function of the arrangement of FIGS. 3 and 4 is essentially similar to that of FIG. 2, molten $NaAlCl_4$ entering the bottom of the housing 12 at a central position, and being distributed by the plates 26, so that it flows upwardly around the tubes 14 between the plates 26, and thence over the upper edges of the plates 26 to the outlet through the seal 16.2 to the conduit 36.

Figure 5:
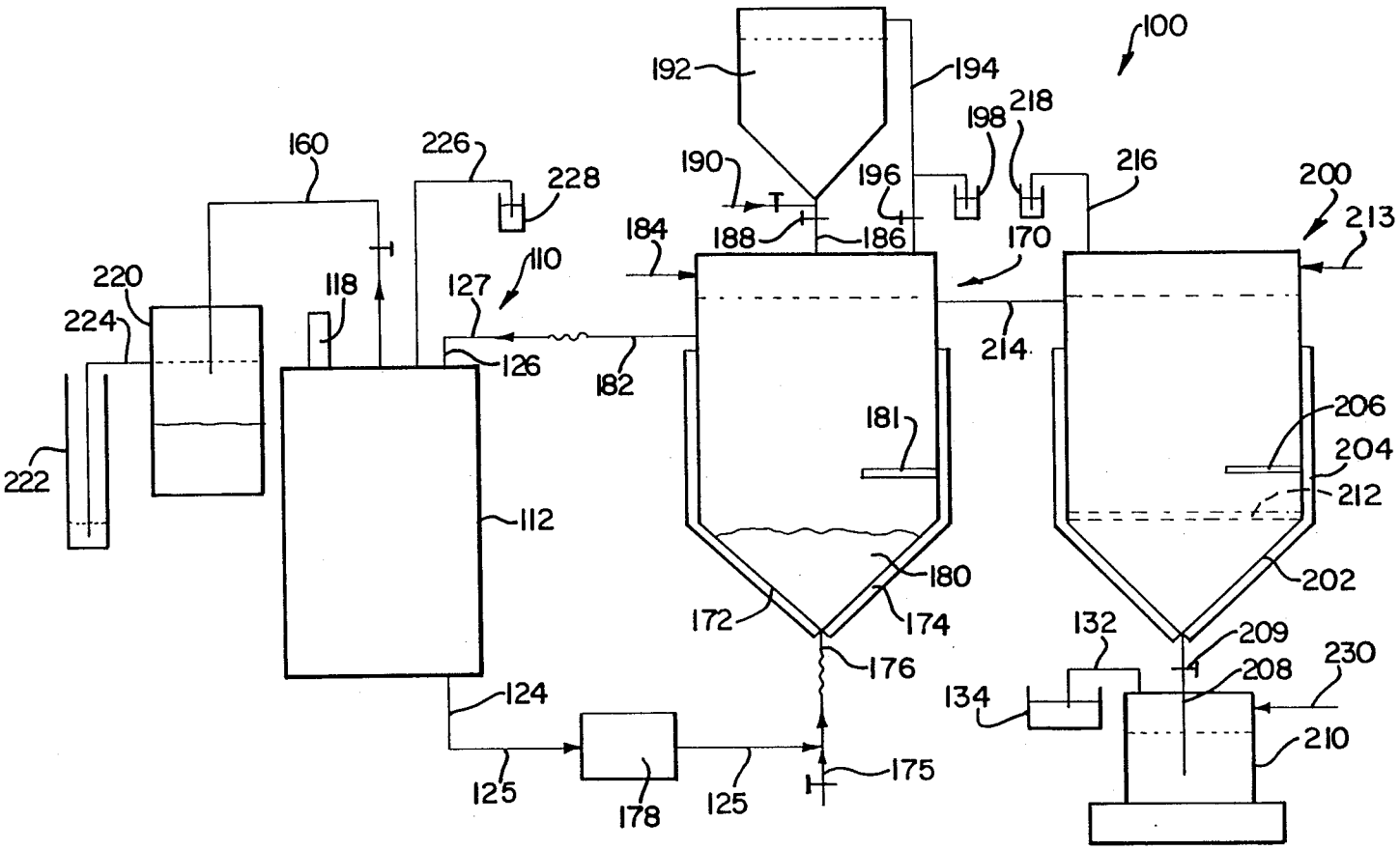
FIG. 5 shows, diagrammatically, another cell in accordance with the invention.
Figure 6:
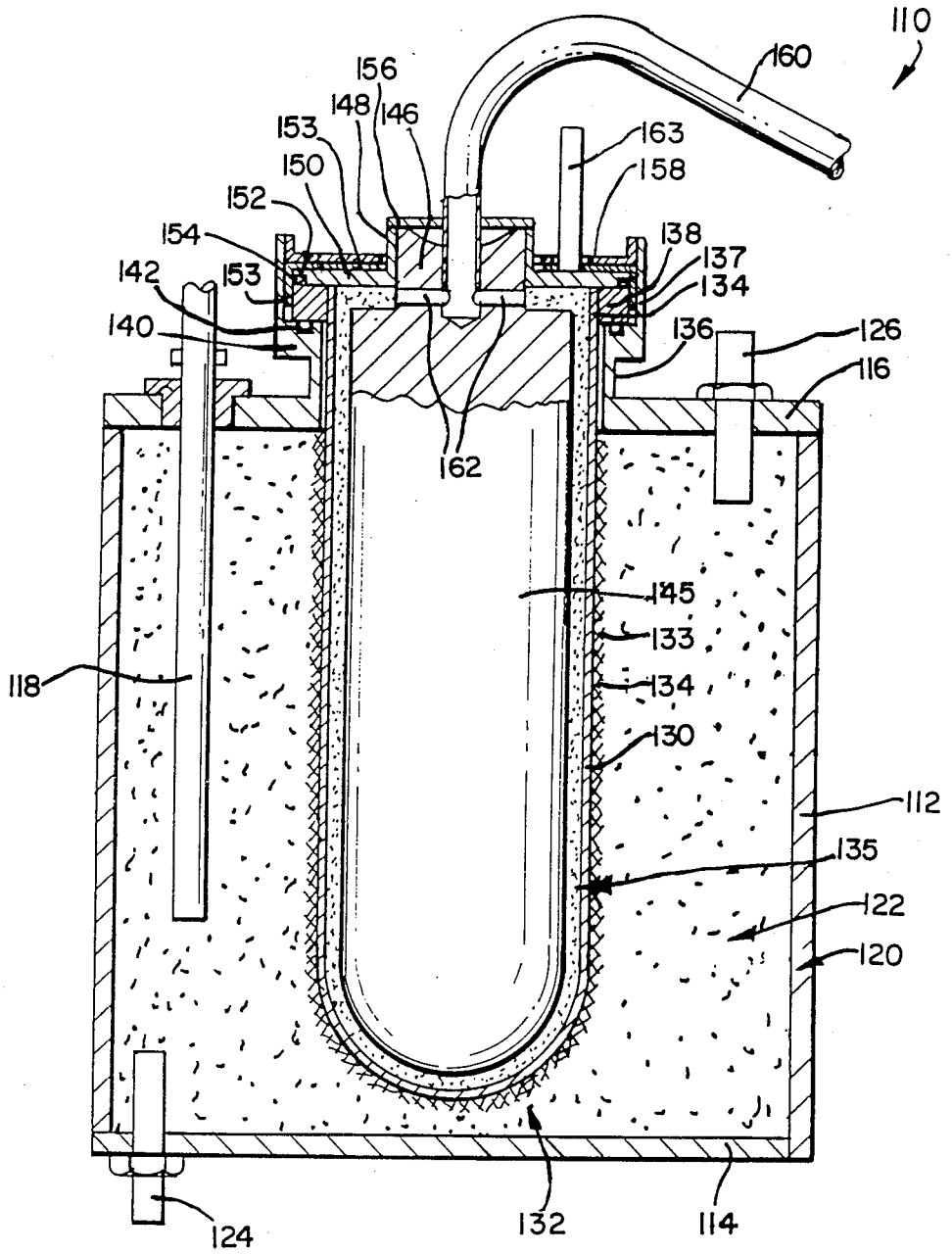
FIG. 6 shows a schematic sectional side elevation of a reactor forming part of the cell of FIG. 5.

Referring to FIGS. 5 and 6, reference numeral 100 generally indicates an electrolytic cell somewhat similar in certain respects to the electrolyte cell of FIG. 2.

The cell 100 includes a reactor 110, a primary vessel 170, and a secondary vessel 220, the reactor and vessels being interconnected as described in more detail hereunder.

The reactor 110 includes a circular section cylindrical housing 112 fitted with a floor 114 and a cover 116. These components can, e.g. be of mild steel. The housing 112 provides a compartment 120, containing molten $NaAlCl_4$, designated 122. A tubular connector 124 leads from the floor 114, for withdrawing $NaAlCl_4$ from the compartment 120, while a tubular connector 126 leads into the cover 116, for returning $NaAlCl_4$ and NaCl to the compartment 120. The points of entry of the connector 124, 126, when the reactor 110 is seen in plan view, are staggered 180° apart, i.e. diametrically opposed. A consumable aluminum bar 118 protrudes sealingly through the roof 116 into the compartment 120, the bar being connected to the positive pole of an external electrical DC circuit (not shown).

The reactor 110 also includes a circular cylindrical beta-alumina separator tube 130, with the one closed end at 132. The tube 130 provides a compartment 135. A replaceable lining or shell 133, e.g. a felt or paper of ceramic or the like porous material is provided around the outside of the tube 130, optionally impregnated with NaCl powder, to protect it against $AlCl_3$ poisoning.

Instead, or additionally, another protective material e.g. NaCl, can be located adjacent the separator. The physical remoteness of the connectors 124,126 also assists in minimizing $AlCl_3$ poisoning of the separator 130. The aluminum bar 118 can also be replaced with an aluminum sleeve around the separator 130, for this purpose, if desired.

The other or upper end 134 of the tube extends with clearance through a central aperture in the cover 116 and a sleeve 136 protruding outwardly from the cover 116, around the central aperture. The tube end 134 is attached, e.g. welded by glass, to a alpha alumina insulating ring 138 seated on a stepped portion 140 of the sleeve 136, with an O-ring 142, in an annular groove in the stepped portion 140, located sealingly between the ring 138 and the stepped portion 140.

An insert or plug 145 e.g. of steel or Al is located within the tube 130. The shape of the insert is complementary to that of the tube 130, so that the compartment 135 is in the form of an annular gap or space between the insert 1475 and the tube 130. An axially extending mounting member 146 protrudes upwardly from the insert 145, and is sealingly connected to a sleeve 148. A circumferential flange or disc 150 extends radially outwardly from the sleeve 148, and is provided with an annular groove 152 in which is located an O-ring 154. The ring 154 is hence sealingly located between the disc 150 and the ring 138. Electrically insulating material 153 is located between the ring 138 and a portion 137 of the sleeve 136, between the outer periphery of the disc 150 and the portion 137, and above the disc 150.

A disc 156 closes off the upper end of the sleeve 148, with an annular disc 158 located above the flange or disc 150, ao that the insulating material 153 is sandwiched between the disc 150, 158. The outer periphery of the disc 158 is secured to the portion 137.

The member 146 is provided with an axial Na withdrawal passageway, to which is fitted a conduit 160 e.g. of TEFLON (trade name), Diametrically opposed radial passageways 162 lead from the compartment 135 to the axial passageway in the insert.

A aluminum current collector 163 for the compartment 135 is mounted to the disc 150, and protrudes with clearance through an aperture in the disc 158, so that it is not in electrical contact with the disc 158.

The primary vessel 170 is of glass, and has a conical floor 172. Heaters 174 are provided around the vessel 170, with a flexible conduit 125, which can be of flexible TEFLON, leading from the reactor connector 124 into the bottom of the vessel 170 via a glass connector 176. The conduit 125 is fitted with a positive displacement pump 178. Glass wool 180 is located in the bottom of the vessel 170. A thermocouple 181 is located in the vessel 170. A glass tubular connector 182 leads from the vessel 170 near its upper end and is connected to a flexible TEFLON conduit 127 attached to the connector 126. An inert gas, e.g. argon, pipeline 184 leads into the top of the vessel 170, as well as a conduit 186, fitted with a valve 188 and an argon pipeline 190. The conduit 186 leads from the bottom of a NaCl storage vessel 192. A conduit 194 leads from the top of the vessel 170 to the top of the vessel 192, and is fitted with a valve 196 and a paraffin trap 198 which acts as pressure relief means. The NaCl used should be as pure as possible e.g. be free of damaging alkali metals, alkaline earth metals or other poisons for beta alumina which if present, will reduce the life of the separator 130. The NaCl should also be kept free of water. If there is water present in the $NaAlCl_4$ system, which in practice has been found to be unavoidable at times, this will result in production of HCl in the $NaAlCl_4$. The $NaAlCl_4$ can then be passed over aluminum which getters the HCl therein, to form $H_2$ and $AlCl_3$, which are acceptable. On the anode side there is at times unavoidable oxygen-contact, and hence an oxygen getter can be provided in the sodium eg magnesium or titanium.

The secondary vessel 200 is also of glass and also has a conical bottom 202, and is also fitted with heaters 204 and a thermocouple 206.

A conduit 208 having a valve 209 leads from the bottom of the vessel 200 into a sealed collection vessel 210 fitted with an argon purge 230. In the vessel 210, the $NaAlCl_4$ product is collected. A paraffin trap 134 for the argon is connected to the vessel 210 by means of a flow line 132. A filter 212 is provided in a lower region of the vessel 200, below the outlet of a conduit 214 leading from the top of the vessel 170 to the top of the vessel 200. A conduit 216 leads from the top of the vessel 200 to a paraffin trap 218 which forms pressure relief means. A argon line 213 leads into the top of the vessel.

The conduit 160 leads into a vessel 220 in which sodium is collected in paraffin, with paraffin overflow as the vessel 220 fills with sodium, being collected in a vessel 222 via a flow line 224 leading from the vessel 220.

A conduit 226 leads through the cover 116 from the compartment 120 to a paraffin trap 228 which forms pressure relief means.

In use, an electrical potential is applied across the bar 118 and current collector 163. In the reactor 110, the reactions as hereinbefore described take place. $NaAlCl_4$ produced in the compartment 120 is withdrawn via the pump 178 and pump into the bottom of the vessel 170, in which it is contacted with NaCl entering the vessel 170 from the vessel 192. Hence in the vessel 170, reaction (5) as described above takes place. Substantially pure $NaAlCl_4$ thus passes to the vessel 200 via the flow line 214, where it is filtered by the filter 212 before being withdrawn as a product into the vessel 210.

Substantially pure $NaAlCl_4$, comprising an equimolar mix of NaCl and $AlCl_3$ is recirculated to the compartment 120 of the reactor 110 via the conduits 182, 127.

Sodium produced in the compartment 135 passes as a product via the conduit 160 into the vessel 220. Instead, the sodium produced can be processed further immediately eg reacted with water to produce NaOH; contacted with a solvent for the sodium; or the like.

The Applicant believes that the cell 100 has various desirable safety features, such as Due to the location of the pump 178, $NaAlCl_4$ is withdrawn from the reactor rather than pumped into it, to reduce the likelihood of overpressure in the reactor, with $NaAlCl_4$ re-entering the reactor essentially under gravity only;

any excess pressure in the reactor, e.g. due to excessive pumping rate or accelerated chemical reaction, will be relieved through the pressure relief means 228;

purging of the equipment with inert gas (argon) can be effected via the purge lines 184, 190 and 213, and via the pressure relief means 198, 218.

the glass wool 180 reduces the likelihood of blockage of the connector 176 with NaCl;

due to the insert 145, the volume of sodium in the reactor 110 is minimized; and if desired, the sodium side of the tube 130 can be lined with a wick or other safety medium; and the paraffin bath 220 acts as a non-return valve, these features all reducing the amount of molten sodium released, and its mobility, should the tube 130 break.

It is an advantage of the invention that both raw materials used, ie aluminum and sodium chloride, are readily available at reasonable cost in a high degree of purity, so that the invention provides a simple and easily operable method of producing $NaAlCl_4$ of a high degree of purity, while producing sodium, as a valuable by-product, likewise of a high degree of purity.

It should also be noted that solid conductors of sodium ions such as nasicon and beta-alumina, while suitable for $NaAlCl_4$ production, or indeed for $NaAlHal_4$ production, are not necessarily suitable, because of possible poisoning of the solid electrolyte, for $NAlHal_3$ production where N is other than sodium. Where N is another alkali metal, such as lithium or postassium, a different suitable solid conductor of ions of the alkali metal in question should be empolyed, or a micromolecular sieve separator, such as zeolite, having the alkali metal in question sorbed therein.

Finally, it should be noted that poising of the beta-alumina tube 130 is expected to be a limiting factor of the durability of the cell and reactor. Apart from poisions in the starting materials, which should be avoided as mentioned above, the main factor tending to poison the tube 130 is expected to be $AlCl_3$ provided by reaction (4) above. The cell and reactor of FIGS. 5 and 6 thus incorporated a number of features to combat $AlCl_3$ poisoning of the tube 130.

$AlCl_3$ provided by reaction (4 ) adjacent the bar 118. The lining or shell 134 acts as a barrier to the concentration gradient of $AlCl_3$ which causes this migration, and the NaCl particles in the shell 134 act to remove the $AlCl_3$ by reaction (5) before it reaches the shell 134. The shell 134 is thus replaced periodically before its NaCl is exhausted. Furthermore, the relative position of the tube 130, bar 118 and connectors 124, 126 (with the bar 118 more or less between the tube 130 and connector 124) are such that flow of $NaAlCl_4$ through the compartment is in a direction past the tube 130, between the tube 130 and bar 118, and generally in the direction from the bar 118 away from the tube 130 towards the connector 124. This sweeps $AlCl_3$ away from the tube 130 and into the vessel 170 where it is thoroughly reacted by reaction (5) with NaCl, in what amounts to a fluidized bed, the fluidization carrier being argon fed in through flow line 175. Very little, if any $AlCl_3$ need enter the housing 112 via connector 126, and the $NaAlCl_4$ entering the housing from the vessel 170 can carry over fine particles of NaCl which help combat migration of $AlCl_3$ from bar 118 to tube 130. It is also to be noted that any microscopic particles of NaCl carried over through the filter 212 in the product $NaAlCl_4$ are not, for an intended use of this product as an electrolyte, regarded as an impurity therein. However, for other uses in which it could be regarded as an impurity, a NaCl removal stage may be provided eg a settling vessel.

We claim:

1. A method of making an (alkali metal) (metal) halide compound and alkali metal, which compound has the formula $MDHal_{x+1}$ in which D is a metal M is an alkali metal;

Hal is a halide; and x is the valency of the metal D comprises exposing to one another in an electrolytic cell a molten $MDHal_{x+1}$ compound as defined above, a metal (D) in the form of a consumable electrode, and an alkali metal halide according to the formula MHal where M and Hal in the MHal are defined above and are the same alkali metal and halide respectively as in the $MDHal_{x+1}$, separating the $MDHal_{x+1}$ compound from a molten alkali metal which is the same as the alkali metal in the $MDHal_{x+1}$ and the MHal, by means of a separator which is in contact with both said molten $MDHal_{x+1}$ and molten alkali metal and comprises a solid conductor of ions of the alkali metal or comprises a micromolecular sieve having said alkali metal absorbing therein, and applying a sufficient electrical potential across the electrolytic cell $D/MHal/MDHal_{x+1}$ || separator || alkali metal to cause the following reactions to take place:

$$xMHal + D \rightarrow xM + DHal_x \quad (1);$$

and $$MHal + DHal_x \rightarrow MDHal_{x+1} \quad (2).$$

the consumable electrode providing the source of the metal (D) in the $MDHal_{x+1}$ compound formed in reaction (2), the alkali metal formed in reaction (1) passing through a separator and into the molten alkali metal, and the electrical potential being a direct current potential arranged so that electrons are fed via an external circuit into the molten alkali metal.

2. A method as claimed in claim 1 wherein the metal D is a member of the group comprising aluminum (in which case x is 3), and zinc (in which case x is 2), the separator being a solid conductor of alkali metal ions, so that the alkali metal formed in reaction (1) passes through the separator in ionic formed and is discharged to the metallic form when it is released from the separator into the molten alkali metal.

3. A method as claimed in claim 2, which is carried out continuously, with the metal D being aluminum, and MHal being added continuously in stoichiometric proportions to the $MAlHal_4$ on one side of the separator, $MAlHal_4$ being continuously withdrawn, as it is produced, from that side of the separator, and alkali metal continuously being withdrawn, as it is produced, from the other side of the separator.

4. A method as claimed in claim 3, wherein the reactions are carried out at a temperature at which both the $MAlHal_4$ and alkali metal are molten, but at which the alkali metal halide and aluminum are present in solid form, the alkali metal halide in finely divided particulate form and the aluminum being a unitary mass and acting as a terminal for the external circuit.

5. A method as claimed in claim 3, in which the electrolyte is sodium aluminum chloride according to the formula $NaAlCl_4$, the alkali metal halide being sodium chloride, the alkali metal being sodium, and the separator being beta-alumina, with the cell operating at a temperature of at least 165° C. and the electrical potential applied being at least 1.8 volts.

6. A method as claimed in claim 3, which includes carrying out reactions (1) and (2) in physically separate zones and circulating, as a solution in the $MAlHal_4$, the $AlHal_3$ from a first zone where it is provided to a second zone containing the MHal where it reacts with the MHal according to reaction (2) to produce the $MAlHal_4$, and recirculating the $MAlHal_4$ back to the first zone.

7. A method as claimed in claim 2 which is carried out continuously, with the metal D being zinc, and MHal being added continuously in stoichiometric proportions to the $MZnHal_3$ on one side of the separator, $MZnHal_3$ being continuously withdrawn, as it is produced, form that side of the separator, and alkali metal continuously being withdrawn, as it is produced, from the other side of the separator.

8. An (alkali metal) (metal) halide compound and alkali metal when made by a method as claim in claim 1.

* * * * *

UNITED STATES PATENT AND TRADEMARK OFFICE

CERTIFICATE OF CORRECTION

PATENT NO. : 4,846,943

DATED : July 11, 1989

INVENTOR(S) : Johan Coetzer and Roger J. Wedlake

It is certified that error appears in the above-identified patent and that said Letters Patent is hereby corrected as shown below:

Column 7, line 23 change "1475" to --145--
Column 9, line 26 change "poising" to --poisoning--
Column 9, line 35 insert "is" between "$AlCl_3$" and "provided"
Column 9, line 36 change "134" to --133--
Column 9, line 38 change "134" to --133--
Column 9, line 39 change "134" to --133--
Column 9, line 40 change "134" to --133--

In the Drawings:

Figure 6, approximately in the middle of the drawing, remove the reference number "134" that is adjacent and below reference number "133," and adjacent and above reference number "130."

Signed and Sealed this

Nineteenth Day of January, 1993

*Attest:*

DOUGLAS B. COMER

*Attesting Officer*

*Acting Commissioner of Patents and Trademarks*